United States Patent [19]

Matsui et al.

[11] Patent Number: 4,877,194

[45] Date of Patent: Oct. 31, 1989

[54] METHOD FOR PREVENTING DEFECTIVE SPLICING FOR AUTOMATIC WINDERS

[75] Inventors: Isamu Matsui, Kyoto; Kenji Ohashi, Uji; Koji Deno, Oumihachiman, all of Japan

[73] Assignee: Murata Kikai Kabushiki Kaisha, Kyoto, Japan

[21] Appl. No.: 183,977

[22] Filed: Apr. 20, 1988

[30] Foreign Application Priority Data

| | | | |
|---|---|---|---|
| Apr. 22, 1987 | [JP] | Japan | 62-99447 |
| Apr. 30, 1987 | [JP] | Japan | 62-106878 |
| Nov. 12, 1987 | [JP] | Japan | 62-284297 |

[51] Int. Cl.[4] ..... B65H 54/22; D01H 15/00

[52] U.S. Cl. ..... 242/35.6 R; 57/22

[58] Field of Search ..... 242/35.6 R, 35.5 R, 242/36; 57/22, 261

[56] References Cited

U.S. PATENT DOCUMENTS

| | | | |
|---|---|---|---|
| 3,220,758 | 11/1965 | Raasch et al. | 242/35.6 R X |
| 3,289,957 | 12/1966 | Wilms et al. | 242/35.6 R |
| 3,294,326 | 12/1966 | Raasch | 242/35.6 R |
| 3,458,912 | 8/1969 | Werffeli | 242/35.6 R X |
| 3,595,493 | 7/1971 | Tsukuma et al. | 242/35.6 R |
| 3,776,479 | 12/1973 | Lutovsky et al. | 242/35.6 R |
| 3,918,651 | 11/1975 | Uchida | 242/35.6 R |
| 4,075,744 | 2/1978 | Mista et al. | 242/35.6 R X |
| 4,232,509 | 11/1980 | Rohner et al. | 242/35.6 R X |
| 4,263,775 | 4/1981 | Mima | 57/22 |
| 4,314,437 | 2/1982 | Rohner et al. | 57/22 |
| 4,411,128 | 10/1983 | Mima | 57/22 |
| 4,414,798 | 11/1983 | Matsui et al. | 57/22 |
| 4,529,233 | 7/1985 | Rohner | 289/1.5 |
| 4,538,407 | 9/1985 | Matsui et al. | 57/22 |

*Primary Examiner*—Stanley N. Gilreath

*Attorney, Agent, or Firm*—Spensley, Horn, Jubas & Lubitz

[57] ABSTRACT

In a yarn splicing process comprising steps of allowing a yarn from a bobbin and a yarn leading to a package to intersect with each other in a yarn splicing device; cutting off yarn end portions extending from the yarn splicing device; splicing the cut yarn ends; and re-starting the winding operation for winding up a yarn on a package from a bobbin, the process further includes steps of clamping the superfluous yarn branching off from the spliced joint before starting a drum to wind a yarn on a package to prevent a defective splicing.

20 Claims, 12 Drawing Sheets

METHOD FOR PREVENTING DEFECTIVE SPLICING FOR AUTOMATIC WINDERS

FIELD OF THE INVENTION

The present invention relates in general to a method of splicing cut yarns for automatic winders, and in particular to such a method in which defective splicing can be prevented.

RELATED ART STATEMENT

In the prior art, there have been developed various types of yarn joining devices for automatic winders such as fisherman's knotter and weaver's knotter, which joint cut yarns in a mechanical manner, as well as a pneumatic yarn splicing device which splices by the action of compressive fluid.

These yarn splicing devices are installed in the passage of the yarn in winding units. In normal yarn rewinding, the yarn after being drawn from the bobbin is checked for a defect by a defect detector while passed over the yarn splicing unit before it is wounded onto a package by a rotating traverse motion. When a defect such as a cut or a slub is detected by the defect detector, a signal is sent to the yarn splicer to operate. When the defect is a cut, the yarn splicer splices the yarn. In the case of a slub, a cutter cut the yarn and the splicer splices the cut yarn ends into a continuous length of yarn.

FIG. 1 shows an example of a conventional yarn splicing device installed in a winding unit. In the drawing, the yarn splicing device 12 is installed at a location between a take-up package P and a defect detector which detects a defect such as a slub in the yarn Y1 as it is drawn from the bobbin B.

In the prior art yarn splicing devices, as shown in FIG. 15, the yarn YP to the package P was drawn into the yarn splicing portion 101 by the suction mouth 11. The yarn YB from the bobbin B is also drawn into the splicing portion 101 by the relay pipe 10. Then, a pair of upper and lower cutters 106 and 107, which are mounted on opposite sides of the splicing portion 101, cut off the yarn portion YB2 leading to the relay pipe 10 and the yarn portion YP2 sucked up by the suction mouth 11, thereby removing the slub. Then, the cut end of the yarn YB from the bobbin B and the one YP to the package P are overlapped and spliced in the splicing hole 37 of the splicing portion 101.

However, if the lower cutter 106 fails to operate, leaving the yarn portion YP2 leading to the suction mouth 11 undetached from the yarn YP to the package P, splicing results in the yarn YB from the bobbin B and the yarn YP from the package P with the yarn portion YP2 left attached thereto. In the case of the pneumatic yarn splicer, operation keeps on without stopping even if the above failure takes places so that, after the yarns YP and YB are spliced, the uncut yarn portion YP2, as shown in FIG. 16, is drawn from the suction mouth 11 and wound, along with the spliced yarn Y1, onto the package P when the package is rotated to restart winding. The installation of a slub catcher at a location between the yarn splicer 101 and the package P in order to prevent the above drawback has been found to provide a solution to this problem. Such a detector is able to detect the presence of an uncut yarn portion containing a slub only when that portion passes the detector. Furthermore, since that yarn portion has a free end, it may pass outside the detector channel of the slub detector, undetected at all.

If the upper cutter 107 (FIG. 15) fails, a similar problem will takes place, allowing the package P to wind up a spliced yarn containing an uncut yarn end portion branched from a spliced joint.

In the yarn splicing device depicted in FIG. 1, the relay pipe 10 is swiveled to the point 10*a* where it catches by suction the end of the yarn YB leading from the bobbin B and then swiveled back to its original position thereby guiding the yarn YB into a predetermined position in the yarn splicing device for splicing. Since the relay pipe 10 is designed to hold a yarn by the effect of suction, it may happen that the yarn is caused to come loose from the relay pipe when some backward pull is exerted on the yarn for one reason or another. Another problem with such splicers is that it can suck up too long a portion of the yarn YB with a resultant increase in the amount of removed end as when the bobbin has too small a release resistance. A further problem is the formation of a triple-leg joint having an extra yarn end extending from the spliced point. This problem may occur, for example, when the relay pipe fails to suck up a sufficient length of the yarn YB (as when the sucked end portion comes loose and slips out of the pipe). As a result, the yarn YB is not properly located at a cutter. The yarn therefore is not cut off at a predetermined point. If this happens, the resultant package will be defective, constituting a trouble in the subsequent stages of weaving.

OBJECT AND SUMMARY OF THE INVENTION

It is an object of the present invention to provide a method for preventing defective splicing wherein a superfluous yarn portion branching off from the spliced joint is removed on re-starting of winding operation after splicing of yarn ends.

According to an embodiment of the present invention, in the yarn splicing process comprising steps of allowing a yarn from a bobbin and a yarn leading to a package to intersect with each other in a yarn splicing device; cutting off yarn end portions extending from the yarn splicing device; splicing the cut yarn ends; and re-starting the winding operation for winding up a yarn on a package from a bobbin, the process further includes a step of clamping a superfluous yarn portion branching off from the spliced joint before starting a drum to wind a yarn on a package.

DETAILED DESCRIPTION OF PREFERRED EMBODIMENTS

Preferred embodiments of the present invention will be described in full detail in conjunction with the accompanying drawings.

Figure 1:
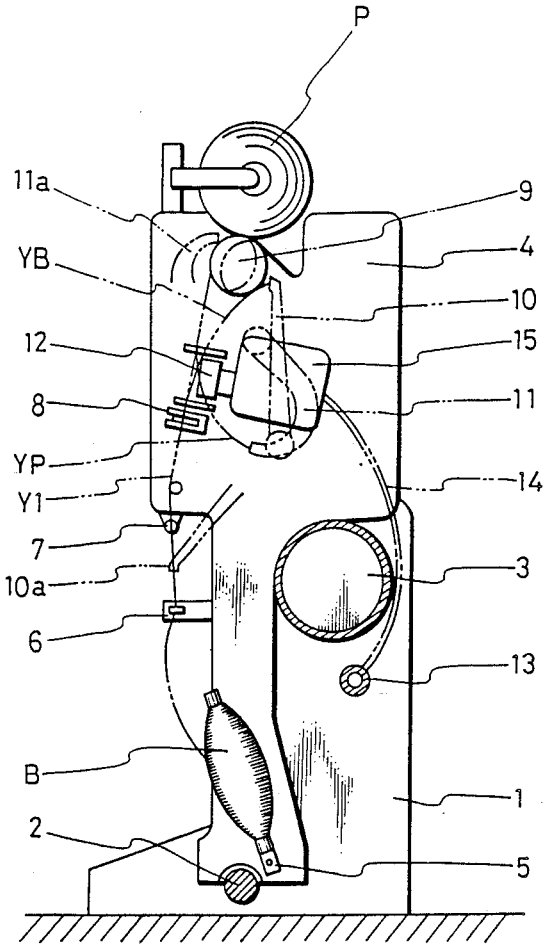
FIG. 1 is a schematic side view of the structure of a winding unit to which the method according to the present invention is applied.

FIG. 1 is a schematic view of a typical automatic winder to which the present invention intended to be applied. Between its side frames 1 the winder has a shaft or pipe 2 and a suction pipe 3 disposed horizontally. A winding unit 4 is swivelably disposed on the shaft 2 for swiveling motion about the shaft. While the automatic winder is in operation, the winding unit 4 is kept immobilized with its bottom portion standing on the pipe 3. The pipe 3 is connected to a blower, not shown, which runs to maintain a vacuum in the pipe during the automatic winder operation to create suction force.

When the yarn Y1 is rewound from a bobbin B onto a package P in the winding unit 4, a tenser 7 holds the yarn in proper taut state upon passing through a guide 6. The yarn Y1 is then checked for a defect such as a slub and for proper passage by a detector 8, which comprises a cutter to cut the yarn if it has a defect, before being wounded onto the package P which is rotated by a traverse drum 9.

When the detector 8 detects a defect in the yarn Y1, the cutter, which may be installed adjacent to the detector 8, is activated to cut the yarn Y1 to two yarns, the one YB coming from the bobbin B and the other leading up to the package P, with the traverse drum 9 being de-activated to stop the winding. Whereupon a relay pipe 10 is caused to pick up the yarn YB while a suction mouth 11 sucking the other yarn YP. The relay pipe 10 and the suction mouth 11 bring their yarns into a yarn splicing device 12 that is located at a point way off from the normal path of the yarn Y1. When the yarns YB and YP are spliced by the splicing device 12, the winding is resumed. The relay pipe 10 and the suction mouth 11 are each connected to the pipe to create a vacuum to hold a cut yarn. Also, the yarn splicing device 12 includes a pipe 13 connected to a separate hydrodynamic system, a splicing box 15, and a duct 14 that is interconnected therebetween to supply compressed fluid from the pipe 13 to the splicing box 15.

Figure 3:
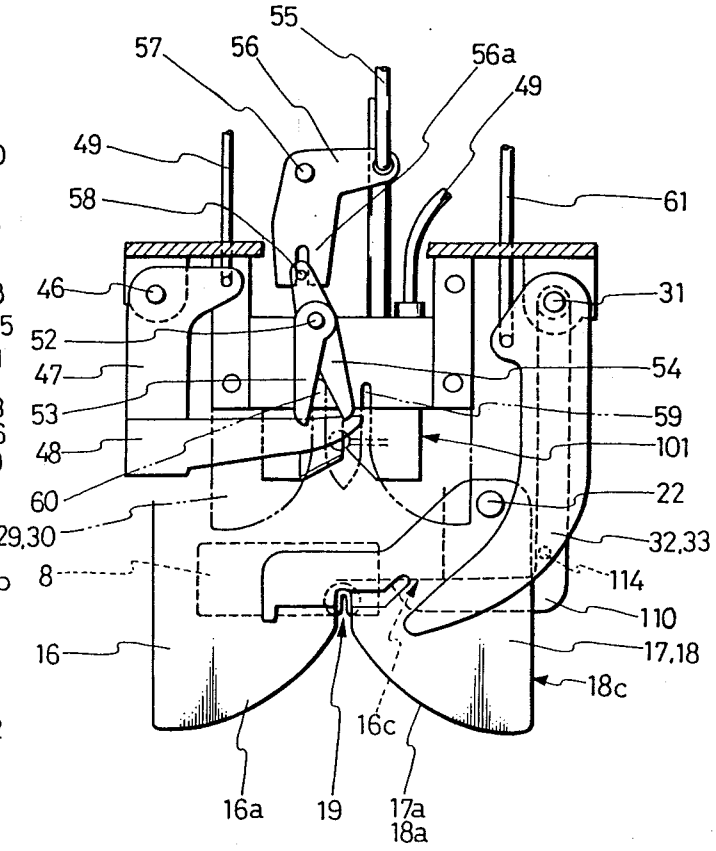
FIG. 3 is a plan view of the yarn splicing device of FIG. 2.
Figure 2:
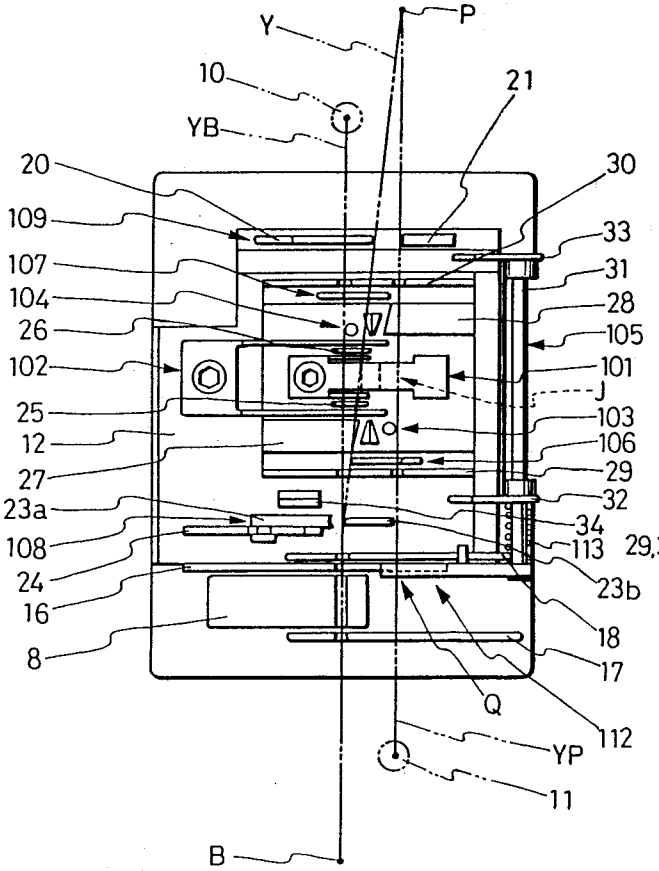
FIG. 2 is a front view of a preferred embodiment of a yarn splicing device in which a method of the present invention is applied.

FIGS. 2 and 3 are respectively schematic views showing the overall structure of the yarn splicing device of FIG. 1. In normal winding, the yarn Y from the bobbin B is allowed to pass the detector 8, a pair of swivelable guides 17 and 18 mounted on opposite sides of the detector 8, and a fixed guide 16 mounted on one side of the detector 8 and go over the yarn splicing device 12 before it reaches the package P.

The yarn splicing device 12 comprises basically a yarn splicing member 101, a yarn pressing device 102, a pair of untwisting nozzle 103 and 104, a yarn handling lever 105, a pair of yarn cutters 106 and 107, and a pair of yarn clamping devices 108 and 109. The relay pipe 10 and the suction mouth 11 have at their forward end a suction port to grasp a yarn by suction. In operation, the relay pipe 10 and the suction mouth 11, with the cut yarns YB and YP leading to the bobbin B and the package P held to their respective suction ports, are swiveled to a point where the yarns YB and YP come to stand crossing each other outside the yarn splicing device 12.

Preferably, it is so designed that the relay pipe 10 and the suction mouth 11 are moved, not in unison with each other, but with a small time lag between them. The suction mouth 11 is first started to bring the yarn YP to the point outside the splicing device 12. Whereupon the package side yarn holder 109 causes a swiveling lever 20 through a control cam, not shown, to swivel anticlockwise to the position 20-1 depicted in broken line in FIG. 4 where the lever is stopped by a support block 21. Referring again to FIG. 4, the yarn Y held by the swiveling lever 20 at its hook portion 20*a* is swiveled to the stop position where the yarn is locked between the lever and the support block 21.

Figure 5:
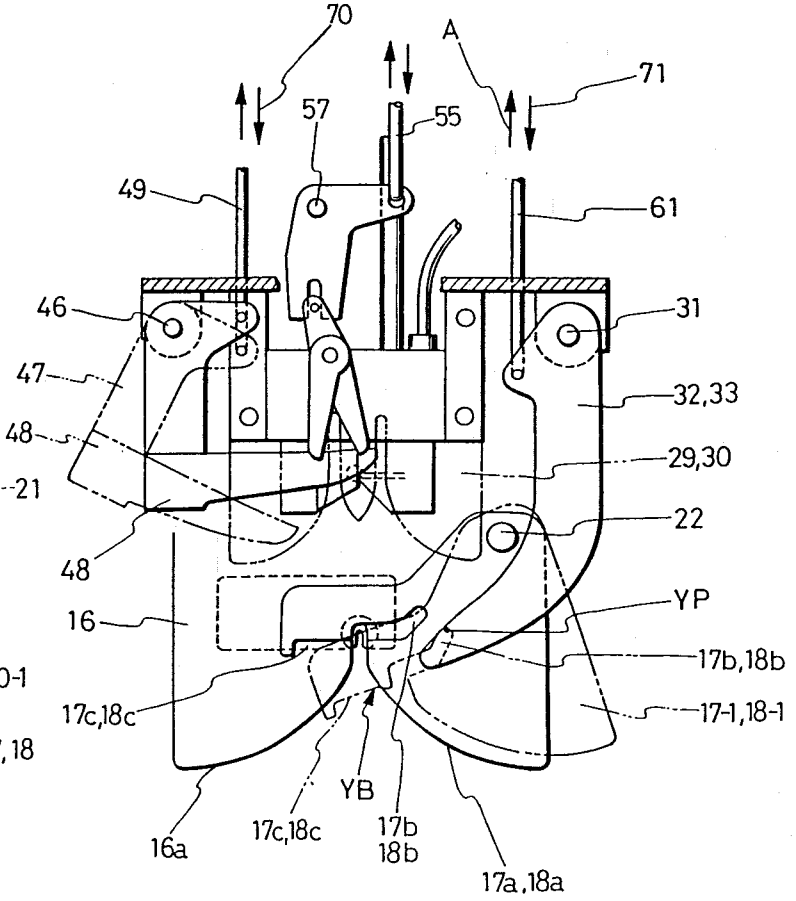
FIGS. 4 and 5 are plan views of the yarn splicing device of FIG. 2 showing its operation.

While the swiveling lever 20 is swiveling, the yarn Y is moved along inclined surfaces 16*a*, 17*a* and 18*a* of the fixed and swiveling guides 16, 17 and 18 into a guide channel 19 where the yarn is checked by the detector 8, which checks whether the swiveling lever 20 carries a yarn and, if it carries, whether the yarn has an additional branch. When the yarn Y is found to have any defect, the swiveling guides 17 and 18 are moved anticlockwise about a common pivot 22, as shown in FIG. 5, by the control cam, not shown, bringing the yarn YP free from the detector 8 into relief grooves 17*b* and 18*b* in the swiveling guides 17 and 18. Also, almost at the same time when the swiveling guides 17 and 18 are swiveled, the yarn YB leading to the bobbin B is grasped by the relay pipe 10, which is then swiveled in the opposite direction the suction mouth 11 is swiveled until it is stopped outside the yarn splicing device 12. Whereupon the yarn holder 108 has a holding plate 23*a* to move the yarn YB through a control cam, not shown, until the yarn comes into contact with a support block 23*b* where it is locked between the holding place 23*a* and the support block 23*b*. As can best be shown in FIG. 5, the yarn YB, held by the hooks 17*c* and 18*c* of the swiveling guides 17 and 18, is checked by the detector 8 before after splicing.

The yarn splicing portion 10 is located in the center of the yarn splicer 12. Also, a pair of yarn guide pipes 25 and 26 are located on opposite sides of the yarn splicing portion 101 adjacent to which the yarn pressing device 102 is mounted. The paired untwisting nozzles 103 and 104, along with a pair of yarn guides 27 and 28, and of fork guides 29 and 30, are provided on opposite sides of the yarn splicing portion. In addition, on one side of the yarn splicing portion 101 is mounted the yarn handler 105 consisting of a pair of swiveling levers 32 and 33 which swivel about a common pivot 31. The operation of the yarn handler 105 is as follows: When the detector 8 detects that the yarn Y has a slub, a cutter not shown, cuts the yarn and the relay pipe 10 and the suction mouth 11 brings their yarn ends YP YB, respectively, over to a point outside the yarn splicing device 12. The yarn handling lever 105 further causes the yarn ends YP and YB to move toward the yarn splicing device 12. The stopper 34 forms a V-shape cross-section between the fork guide 29 and the yarn clamping device 108 where the yarn handler ends its swiveling motion by coming into contact with the stopper. Preferably, the stopper is made movable to adjust the point where the yarn clamping device 108 is stopped.

Figure 7:
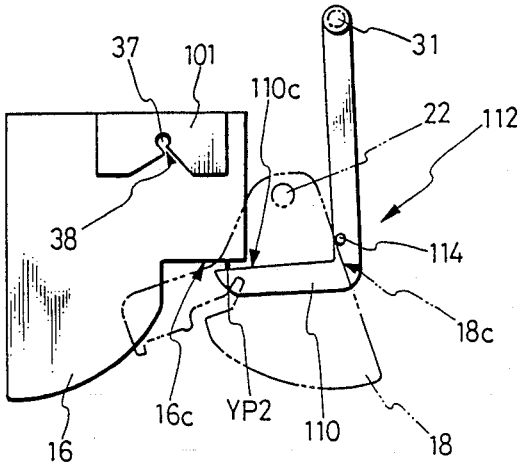
FIG. 7 is a plan view of a clamping device employed to clamp an uncut yarn end portion leading from the package to the suction mouth.
Figure 16:
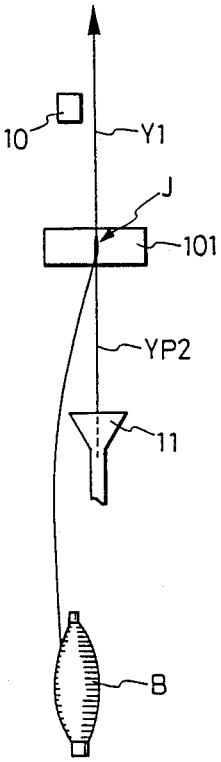
FIG. 16 is an schematic view illustrating how the yarn is spliced with an uncut package-side yarn end portion attached.

Referring further to FIGS. 2, 3 and 7, the fixed guide 16 provides a clamping surface 16*c* where the package side yarn YP is clamped. In this way, when the yarn YP leading to the package is improperly cut by the cutter, the yarn end YP2 left uncut is clamped by the clamping device 112 comprised of the clamping surface 16*c*, the clamping lever 110 and the yarn holding surface 110*c*. In more detail, the clamping lever 110 is freely swivelably disposed for swiveling about the pivot 31 and urged clockwise in FIG. 3 by a spring 113 mounted about the pivot 31. A pin 114 is affixed in the center of the clamping lever 110, and provided to guide the swiveling guide 18 which is moved with its side 18*c* held in contact with the pin 114. It is to be understood that the above description of the clamping mechanism is given by way of illustration as a preferred embodiment without limiting the present invention. Any suitable clamping system capable of clamping the yarn a predetermined point between the suction mouth 11 and the yarn splicing portion 101, as shown in FIG. 2, can substitute this particular embodiment. The point where the clamping mechanism may preferably be as near the yarn splicing portion 101 as possible for the following reason. Referring to FIG. 16, rotation of the drum, with the yarn being clamped between the yarn splicing portion 101 and the suction mouth 11, causes the yarn to be cut at a desirable point between the package P and the yarn splicing portion 101 such that winding of an uncut yarn end onto the package is prevented.

The construction and operation of the relay pipe 10 will be described in detail.

Figure 10:
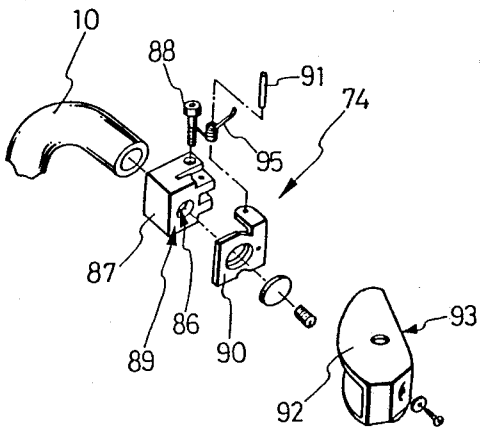
FIG. 10 is a perspective view of a clamping portion mounted at a forward end of the relay pipe.
Figure 9:
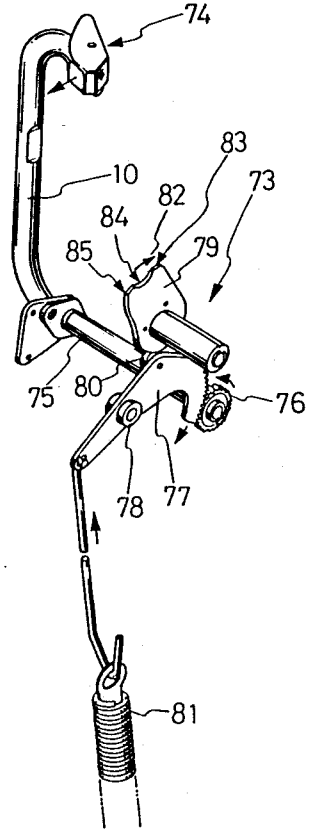
FIG. 9 is a perspective view of a drive mechanism for the relay pipe.
Figure 8:
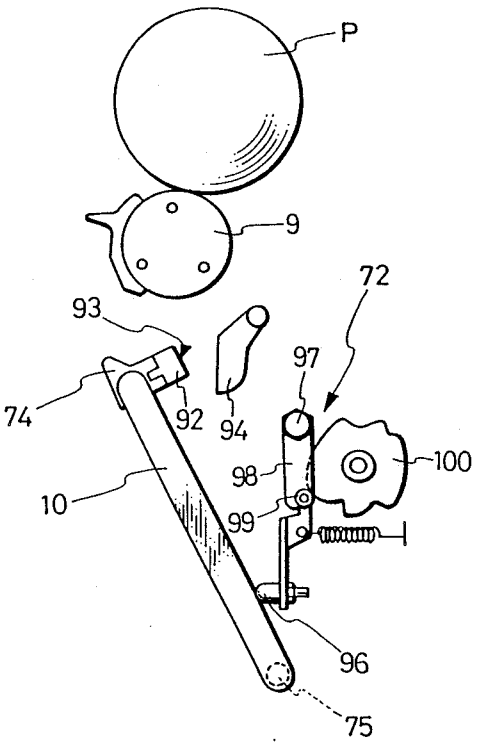
FIG. 8 is a side view of a stopper mechanism for the relay pipe.

FIG. 8 shows a stopper mechanism 72 for the relay pipe 10, and FIG. 9 illustrates a drive mechanism 73 for the relay pipe 10. FIG. 10 is a clamp mechanism 74. Referring first to FIG. 9, the relay pipe 10 is rotatably disposed for rotation in both direction about a hollow shaft 75 through a gear wheel 76 engaged in mesh with a sector gear 77. A cam plate 79 is provided to rotate through a cam follower 80 the sector gear 77 about a fixed shaft 78. A spring 81 is mounted to urge the cam follower 80 against the cam plate 79. With this arrangement, when the cam plate 79 is rotated from the position depicted in FIG. 9 in the direction of the arrow 82 until the its largest diameter portion 83 comes into contact with the cam follower 80, then relay pipe 10 is rotated to its lowest position where the pipe sucks up the end of the bobbin-side yarn. The cam surfaces 83, 84 and 85 of the cam plate 79 allow the relay pipe 10 to back up slightly with the yarn end held sucked.

Referring now to FIG. 10, the clamping portion of the relay pipe has at its open end a block 87 fixed with a screw 88. The block 87 has a throughhole 86 that is in communication with the pipe 86, and includes a clamp plate 90 that is pivoted on a pin 91 for moving close to or away from an end face 89 of the block 87. Also, the relay pipe 10 has a cover 92 that is pivotally disposed to move integral with the clamp plate 90. The cover 92 opens against the force of the spring 95 when its rear end surface 93 comes into contact with a stop plate 94 of which a description will be made later.

Referring to FIG. 8, the relay pipe 10 has a stopper 96 that determines the upper or neutral position of the relay pipe 10. The stopper 96 is secured in the cam lever 98 that is supported by the fixed shaft 97. When the cam follower 99 in the cam lever 98 comes into contact with the cam plate 100, the stopper 96 is caused to rotate anti-clockwise about the shaft 97 through a predetermined angle, causing the relay pipe 10 to rotate clockwise about the shaft 75 following the stopper 96. As a result, the cover 92 of the clamping portion of the relay pipe 10 comes into engagement with the stopper 94 causing the cover 92 to open, which brings the clamp plate 90 to open momentarily. It is possible that the relay pipe 10 has a cam plate similar to the one 100 for itself. However, doing so would necessitate additional modification since the winding unit is already equipped with various cams and levers.

Therefore, in this particular embodiment, the cam plate 100 is employed as a cam plate for the stopper 96 to supply compressive fluid to the yarn splicing hole of the yarn splicing device. Because of this design, the timing of the clamp plate 90 to release at the top end of the relay pipe 10 is when the two yarns are actually spliced.

Theoretically, the timing of the clamp plate 90 to release must be any moment after the upper cutter 107 (FIG. 2) is actuated, with the bobbin-side yarn leading to the relay pipe 10 being introduced into the yarn splicing portion 101 and before the drum is restarted following the splicing operation. In other words, this timing must be after the yarn is cut by the cutter 107 so that the yarn end cut off dangling, grasped by the clamp plate 90 of the relay pipe 10, is sucked into the pipe, at least, after the clamp plate 90 is closed before the drum is started.

Figure 14:
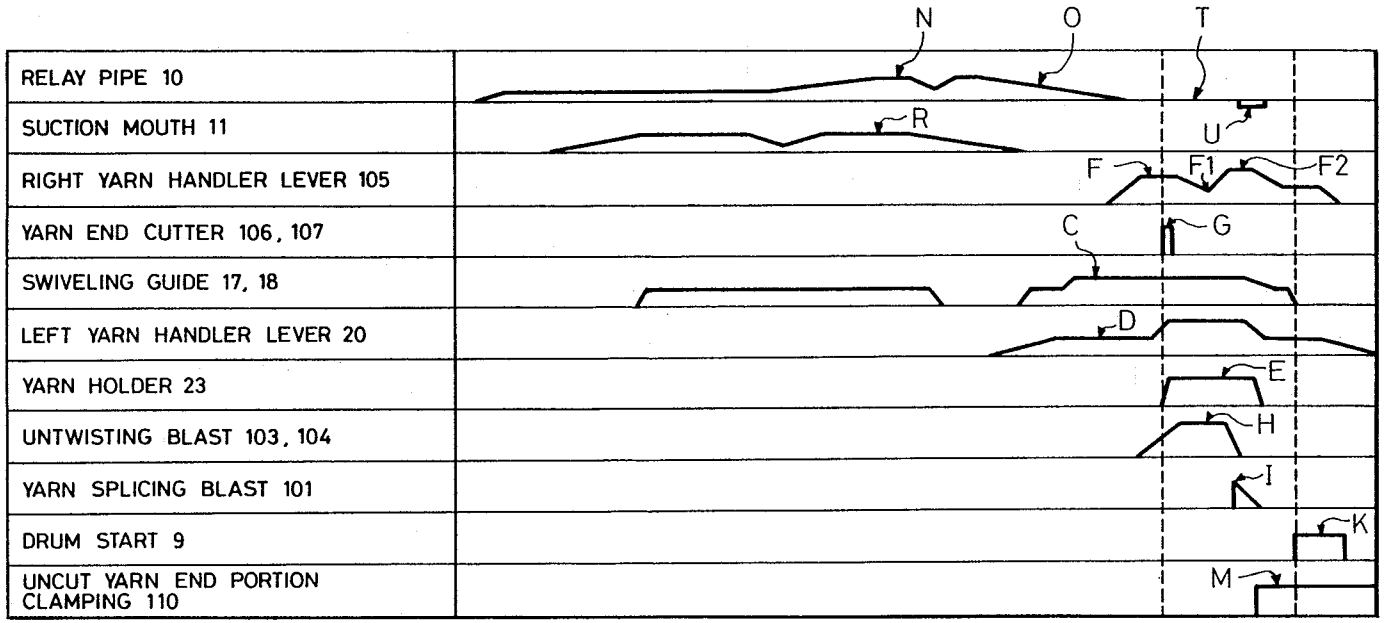
FIG. 14 is a time chart showing the steps of yarn splicing.
Figure 15:
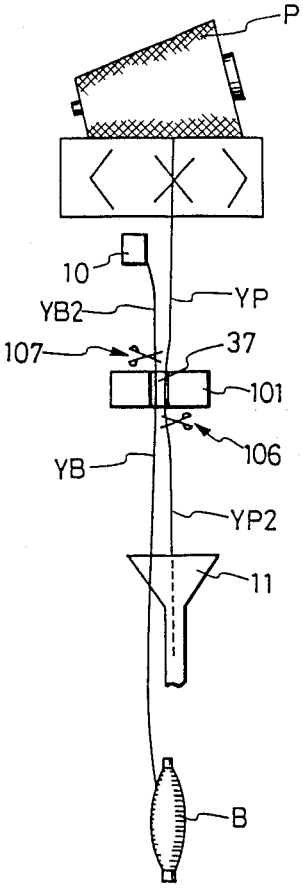
FIG. 15 is an schematic view showing the yarn splicing portion as when a package side yarn end and a bobbin side yarn end are guided thereinto.

The operation of the above device is described in more detail in conjunction with the timing chart of FIG. 14 as well as FIGS. 1 to 6 and 11 to 13.

Referring to FIG. 1, when the detector 8, which is capable of detecting a yarn cut and the absence of a yarn on the bobbin B during winding, detects that no yarn is passing, the drum 9 is stopped and a clutch, not shown, acts so that yarn splicing action is started by various control cams mounted on a shaft rotatably disposed by the clutch or other various cams interlocked with the shaft.

First, the relay pipe 10 and the suction mouth 11 are swiveled, with their respective yarn ends, from the their positions 10*a* and 11*a* depicted in broken line in FIG. 1 to positions where the yarn end YB leading to the bobbin B comes to intersect with the yarn YP leading to the package P, after passing above the yarn splicing device 12 to its outer end.

As stated above, the relay pipe 10 and the suction mouth 11 are not moved simultaneously. The relay pipe 10, with its yarn YB from the bobbin B begins its swiveling movement toward the yarn splicing device 12 a predetermined period of time after the suction mouth 11, with its yarn YP from the package P, completes its motion to the splicing device 12.

Figure 4:
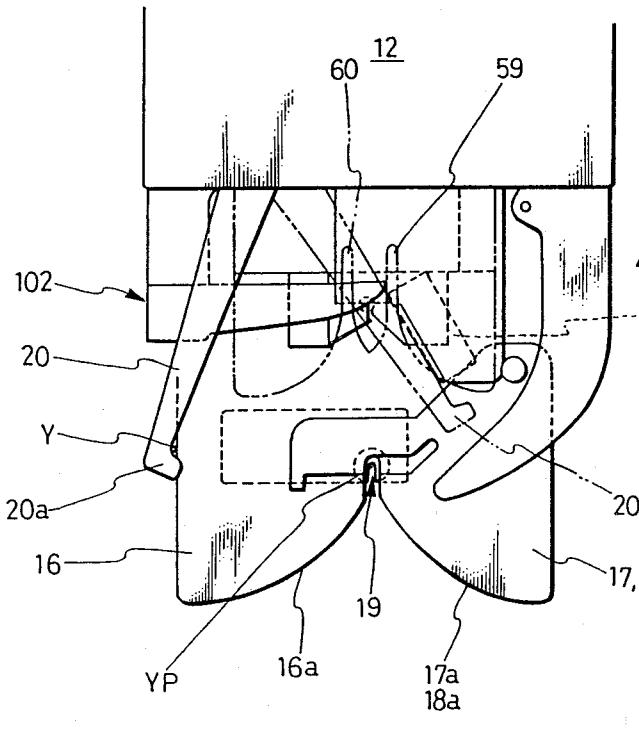

During this predetermined period of time after the suction mouth 11 completes its action but before the relay pipe 10 begins its motion, the following operations are completed as shown in FIGS. 4 and 5. The swiveling lever 20 in the package-side yarn retaining device 109 is activated to allow the yarn YP to be held between the swiveling lever 20 and the support block 21, as depicted in FIG. 4(D), and, at the same time, the yarn YP is passed through the guide channel 19 formed by the fixed guide 16 and the swiveling guides 17 and 18 mounted in the vicinity of the detector 8 so that the detector 8 can checks the yarn for a defect. Then, the yarn YP is released from the detector 8 by causing the swiveling guides 17 and 18 about the shaft 22 to the depicted positions 17-1 and 18-1, respectively, which allows the yarn moves into the clearance grooves 17*b* and 18*b*, as shown in FIG. 14(C).

Figure 6:
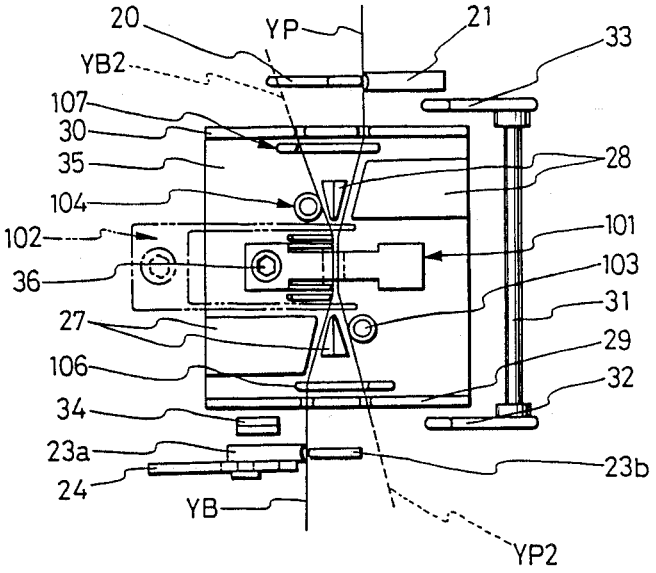
FIG. 6 is a front view of the yarn splicing device of FIG. 2 showing a yarn end portion inserted into the device.

The relay pipe then picks up the bobbin-side yarn YB by suction and swivels to its position outside the yarn splicing device 12. The yarn YB is passed through the hook portions 17*c* and 18*c* of the swiveling guides 17 and 18 and, as shown in FIG. 6, guided into between the support block 23 and the yarn holding plate 23*a* of the yarn clamping device 108 where the yarn is held, as shown in FIG. 14(E). Thus, no checking is done of the bobbin-side yarn YB by the detector 8 until splicing is completed.

At the end of the swiveling action of the relay pipe 10 and the suction mouth 11, the yarn handling lever 105, as illustrated in FIGS. 2 and 6, has its levers 32 and 33 to rotate about the pivot 31, as shown in FIG. 14(E), so that the yarns YB and YP are individually guided into the guide channels 59 and 60 of the fork guides 29 and 30 where the yarns are passed into the splicing hole 37 of the yarn splicing member 101 through the slit 38.

Then, the yarns YB and YP are cut off their superfluous ends YB-2 and YP-2 at predetermined points by the cutters 106 and 107, respectively, at the yarn clamping devices 108 and 109.

Where the yarn YB (YP) is cut is determined the length over which the yarns are spliced, which has an impact on the appearance and strength of the resultant spliced joint. The point where the yarn is cut differs from one yarn count to another.

Figure 11:
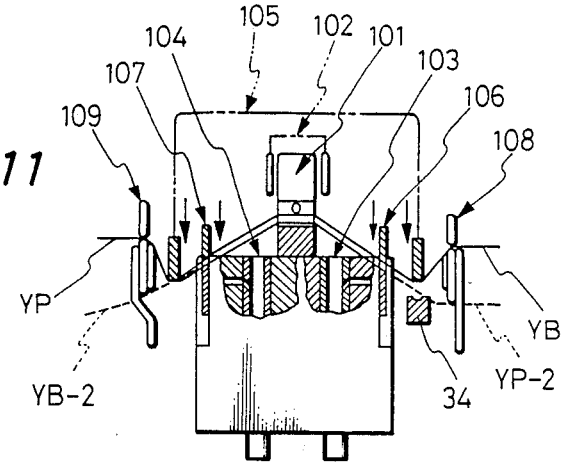
FIGS. 11 through 13 are schematic views showing the steps of yarn splicing.

In more detail, referring to FIG. 11, the yarn YB clamped by the yarn clamping device 108 and the yarn YP clamped by the yarn clamping device 109, are cut when the yarn handling lever 105 is actuated so that the rod 61, shown in FIG. 5, is caused to move in the direction of the arrow A by the action of the control cam, not shown, rotating the levers 32 and 33 clockwise about the pivot 31. While the yarn handling lever 105 and the cutters 106 and 107 are in operation, the yarn pressing device 102 stands at a position where it is rotated clockwise about the pivot 46 by movement of the rod 49 in the direction of the arrow 70, as depicted in FIG. 5.

Figure 12:
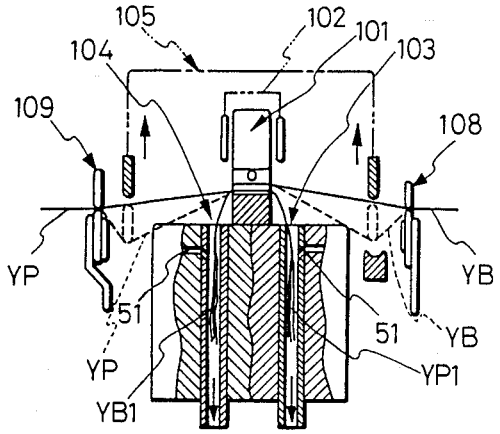
Figure 13:
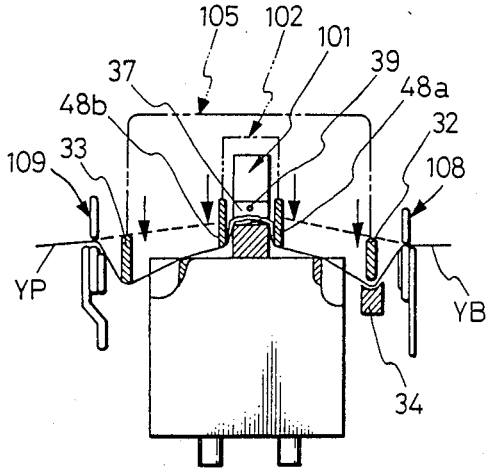

Referring then to FIG. 12 substantially simultaneously or almost at the moment when the yarn ends YB1 and YP1 are sucked in by the untwisting nozzles 103 and 104, respectively, the rod 61 moves in the direction of the arrow 71, as shown in FIG. 5, causing the yarn handling lever 105 to rotate anti-clockwise about the pivot 31, away from the yarn Y. When the yarn ends YB1 and YP1 are forced into the untwisting nozzles 103 and 104 by suction, the injection nozzle 51 produces a jet of compressive fluid rendering the yarn ends loose enough for subsequent untwisting, as shown in FIG. 14(H).

When the yarn handling lever 105 is moved away from the yarn Y, as shown in FIG. 14(F1), the yarn ends YB1 and YP1 are both sucked deep enough into their respective untwisting nozzles.

It is preferable for the untwisting nozzles 103 and 104 to start their sucking operation immediately before yarn end cutting by the cutters 106 and 107 for the following reason. When the yarns YB and YP are cut, the yarn ends YB1 and YP1 tend to fly out, because the suction developed in them by the relay pipe 10 and the suction mouth 11 gives tension to the yarns, too far from the untwisting nozzles 103 and 104 so that the yarn ends cannot be sucked in by the untwisting nozzles. Thus, it is desirable for the untwisting nozzles 103 and 104 to start their operation substantially simultaneously or shortly before or after, or most preferably, immediately before the moment of activating the cutters.

In addition, the untwisting nozzles 103 and 104 are supplied with compressive fluid by changeover of a solenoid actuated valve, not shown.

The yarn ends YB1 and YP1 are rendered loose by the untwisting nozzles 103 and 104, to a proper state for subsequent splicing. Substantially simultaneously or shortly before or after their suction comes to an end, the yarn handling lever 105 is activated again to cause the lever 32 to come into abutting contact with the stopper 34, guiding the yarn ends YB1 and YP1, as shown in FIG. 14(F2). Whereupon the yarn pressing device 102 is actuated to drive the yarn ends YB1 and YP1 out of the untwisting nozzles 103 and 104 into the yarn splicing hole 37 of the yarn splicing portion 101 where the yarn ends are allowed to overlap with each other. At this point, the length of the spliced joint is determined by the distance over which the yarn handling lever 105 and the yarn pressing device 102 are rotated.

It follows from this that the swiveled distance of the yarn handling lever 105 and the yarn pressing device 102 depends on yarn count.

It wound be desirable from the standpoint of stability in operation, but not particularly requisite, for the yarn holding plates 48*a* and 48*b* to hold the yarn ends YB1 and YP1 at a point adjacent to their end.

The yarn ends YB1 and YP1 are spliced in the yarn splicing hole 37 by the action of the compressive fluid discharged in a jet from the injection nozzle 39, as shown in FIG. 14(I). When the splicing is completed, the yarn handler lever 105 and the yarn holder 102 are rotated away from the now spliced yarn Y. Whereupon the drum 9 is stated, as shown in FIG. 14(K), causing the spliced yarn Y to pass out of the yarn splicing portion 101 through the slit 38, and the winding unit 4 resumes winding.

Since the single-cycle operation of splicing has so far been described, what can result from the failure of the lower cutter 106 to cut the package side yarn YP will now be described. When the cutter 106 fails to cut the yarn YP as it is in the channels 17*b* and 18*b*, the yarn Y is left connected between the suction mouth 11 and the package P. In spite of this, when operation is continued activating the yarn splicing device to complete its splicing operation, the swiveling guides 17 and 18 are rotated back to their original positions in due course, with the result that the yarn YP is held locked between the clamping surface 16c of the fixed guide 16 and the clamping surface 110c of the clamp lever 110. Clockwise rotation of the swiveling guides 17 and 18 about the shaft 22 causes the clamp lever 110 to move, bringing the uncut yarn end portion YP2 to be held in fixed position between the clamping surfaces 16c and 110c, as shown in FIG. 14(M).

When the drum 9 is activated, with the uncut yarn portion YP2 still connected to the suction mouth 11 being clamped between the clamping surfaces, rotation of the package P causes the yarn portion YP2 to be forcibly cut at a mid-point between the package P and where the yarn portion is clamped, generally designated at Q in FIG. 2. In more detail, referring to FIG. 2, assuming that the length of the splicing position J formed by the yarn splicing member 101 and the package P is L and the distance between the position J and the suction mouth 11 is l, it is desirable for the uncut yarn portion YP2 to be cut at a point that satisfies $L>l$. Because of actual mechanical limitations, the probability that the yarn portion YP2 is cut within the range of L being 6 times or greater than l is 85.7%.

Then, what can result when the upper cutter 107 fails to cut the yarn leading from the bobbin B to the relay pipe 10, although the cutter 106 operates normally, will be described.

Referring then to FIG. 14, when the relay pipe 10, after rotating from its neutral position to its lower position, indicated by N in the diagram, is rotated backward, indicated by O, with the bobbin side yarn that is picked up at that lower position, the yarn end is held by the clamp plate, as stated above. Even if the sucked length of yarn is short, it can be held tightly by the relay pipe 10 and inserted into the yarn splicing device 12. The package side yarn end is inserted into the yarn splicing device following the locus R of movement of the suction mouth 11.

Figure 17:
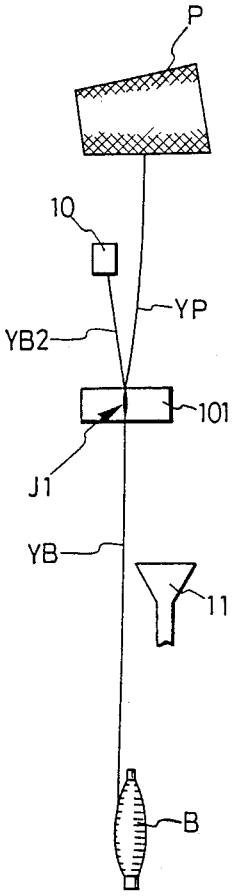
FIG. 17 is an schematic view illustrating how the yarn is spliced with an uncut bobbin side yarn portion attached.

When the yarn splicing device starts its splicing operation in the manner already described above, the relay pipe 10 is maintained in the position depicted in FIG. 8, as shown in FIG. 14(T), with the bobbin side yarn still attached to the relay pipe 10, since the cutter 107 has failed. At the moment when a splicing blast is conducted, as indicated by I in FIG. 14, the cam 100, as can best be shown in FIG. 8, causes the stopper 96 to rotate over a slight distance in the anti-clockwise direction, causing the relay pipe 10 to rotate clockwise about the shaft 75 until the cover 92 of the clamp portion opens the clamp plate 90 by contacting the fixed stopper 94. When the yarn end portion is cut off in normal operation, the cut yarn end portion is sucked into the relay pipe 10, as shown in FIG. 14(U). However, if the yarn end portion is left uncut, the bobbin side yarn remains still attached to the relay pipe 10. When the splicing blast, as shown in FIG. 14(I), is completed, the spliced joint J1 produced is left connected with the yarn end portion YB2 between it and the relay pipe 10, as shown in FIG. 17. As shown, the bobbin side yarn YB is connected to the package side yarn YP through the spliced joint J1 with the yarn end portion YB2 branching off therefrom.

When the drum is started, as indicated by K in FIG. 14, rotation of the package P causes the package side yarn YP to forcibly break the yarn end portion YB grasped by the relay pipe 10 off at a point adjacent to the spliced joint J1. Since the yarn end portion YB is cut at a mid-point between the spliced joint J1 and the relay pipe 10, the package P can proceed with its winding, despite the coupled yarn consisting of the bobbin side and package side yarns YB and YP connected by the splicing J1 with a short branch that is cut off from the yarn end portion YB2. In the yarn end portion YB2 refuses to break for one reason or another, the spliced yarn Y will break at a point somewhere along the spliced joint J1 since it is so arranged in this particular embodiment that the strength of the parent yarn Y is no smaller than that of the spliced joint J1, so that the yarn splicing device is activated again to splice the cut yarns. In either case, winding of a yarn with an additional undetached leg is prevented.

Next, the method for detecting an additional yarn portion branching off from the joint of a spliced yarn using a defect detector for automatic winders will be described in full detail in conjunction with the drawings.

The present invention relates to a method for splicing yarns. An embodiment of the present invention comprises steps of: introducing a yarn from a bobbin and a yarn to a package to intersect with each other in a yarn splicing device; splicing both yarns after a cutter is actuated to cut off a yarn end portion extending from the yarn splicing device; and starting yarn winding operation drawing up a yarn from a bobbin and taking on the yarn on a package, wherein a double yarn is detected by introducing a spliced yarn into a detecting channel of a detector for detecting defect yarn, along with a cut-failed yarn branching off from the spliced joint of the spliced yarn.

Figure 25:
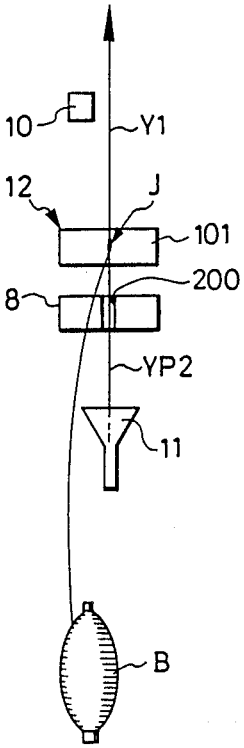
FIG. 25 is an schematic view showing how a double yarn occurs when the cutter fails to cut the package side yarn.

When the spliced yarn has an additional yarn portion branching off from the spliced joint J, as shown in FIG. 25, the spliced yarn Y1 is caused to pass, along with the branching yarn portion YP2, into a detecting channel 200 of a defect detector 8 mounted below the yarn splicing device 12. The detector 8 is provided to detect the presence of a defective splicing such as a double yarn in order to prevent winding of a defective yarn onto a package.

Preferred embodiments for practicing the above method of the present invention will be described in full detail in conjunction with the accompanying drawings.

Figure 19:
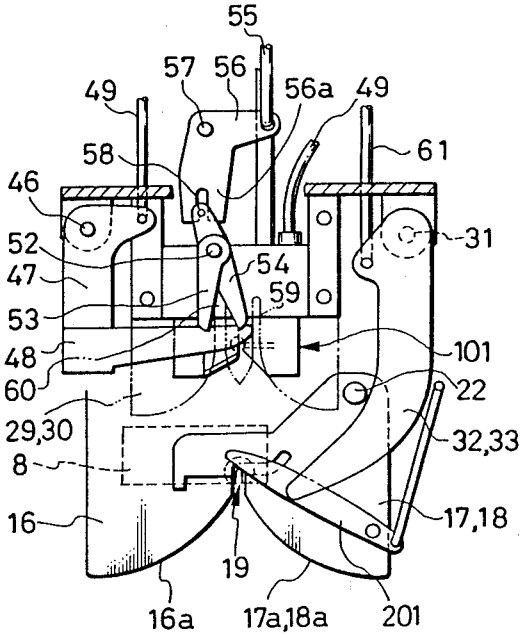
FIG. 19 is a plan view of the yarn splicing device of FIG. 18.
Figure 18:
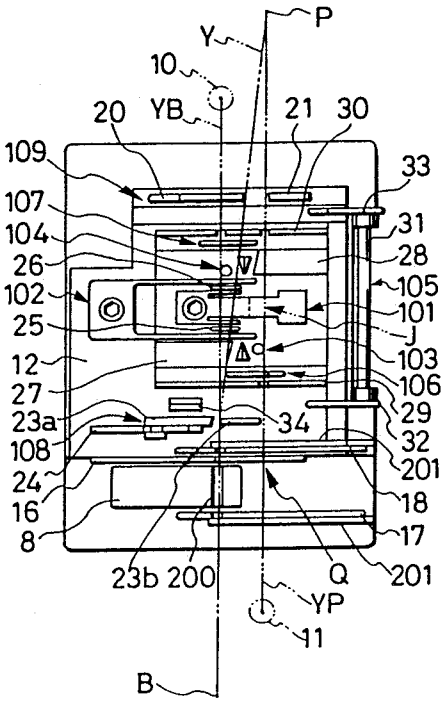
FIG. 18 is a front view of another embodiment of a yarn splicing device to which the method according to the present invention is applied.
Figure 20:
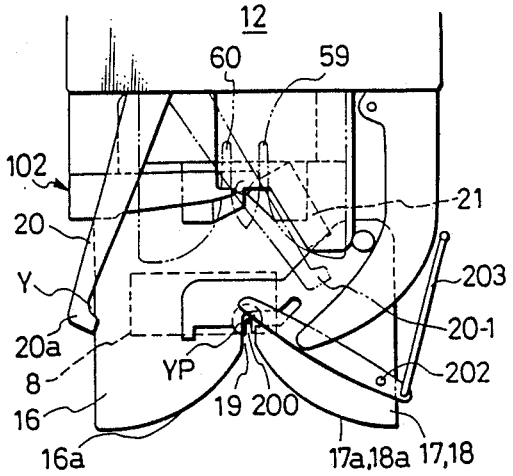
FIGS. 20 and 21 are plan views of the yarn splicing device of FIG. 18 in operating condition.
Figure 23:
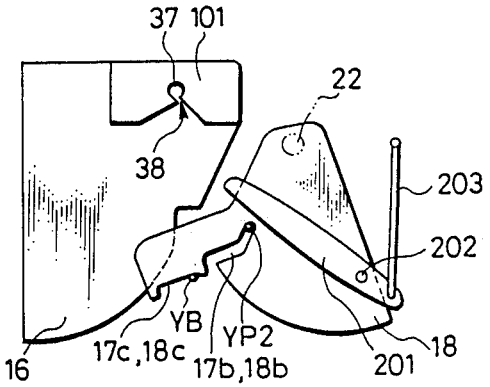
FIG. 23 is a front view of a clamping device employed to clamp an uncut yarn end portion leading from the package to the suction mouth.

FIGS. 18 and 19 are respectively schematic detailed views showing the overall construction of a yarn splicing device 12 which is substantially similar to the yarn splicing device depicted in FIGS. 2 and 3, and like components are referred to by like reference numbers and characters. In this particular embodiment shown in FIGS. 18 and 19 of the present invention, at the end of splicing operation, the swiveling guides 17 and 18 are rotated back from the positions depicted in FIGS. 21 and 23 to the positions shown in FIG. 19. Whereupon the yarn YB engaged in the hook portions 17c and 18c, after splicing, is guided into the detecting channel 200 of the detector 8 and the cut-failed yarn portion YP2 is driven from the relief grooves 17b and 18b into the detecting channel 200 by the yarn ejecting lever 201. The yarn ejecting lever 201 is rotatably mounted on a shaft 202 through the swiveling guides 17 and 18. Also, the yarn ejecting lever is connected at one end thereof to a fixed surface through a link 203 so that anti-clockwise rotation of the swiveling guides 17 and 18 causes the yarn ejecting lever 201 to back out from the relief grooves 17*b* and 18*b*. When the swiveling guides 17 and 18 are rotated back to their original positions, the yarn ejecting lever 201 drives a yarn end portion YP2, if any, from the relief grooves 17*b* and 18*b* toward their entrance. Since the yarn ejecting lever 201 consists of a pair of levers installed on both ends of the detector 8, inspection of a yarn end portion into the detecting channel 200 is insured.

The operation of the yarn splicing device in this embodiment is substantially similar to the previous embodiment and will not be described here to avoided unnecessary repetition.

Figure 21:
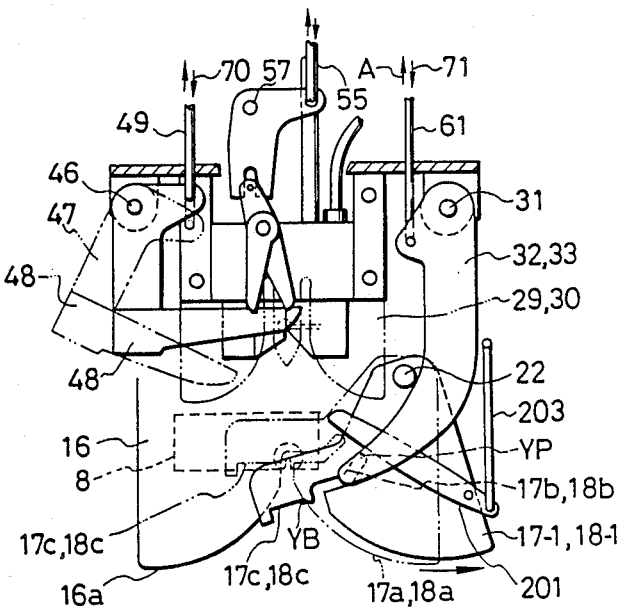
Figure 22:
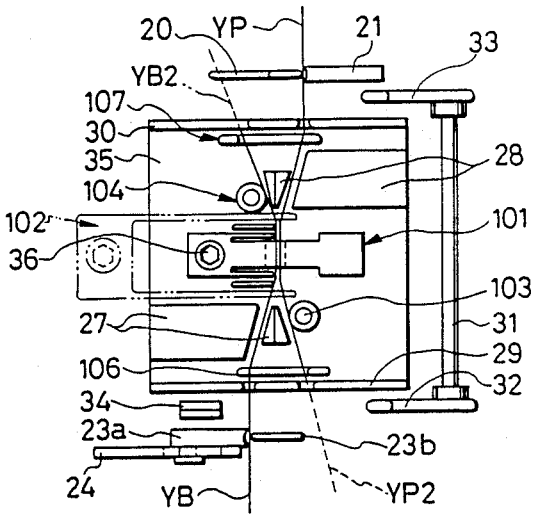
FIG. 22 is a front view of the yarn splicing device as when yarn ends are inserted thereinto.

What can result if the lower cutter 106 fails to cut the package side yarn YP will now be described. When the cutter 106 is actuated, with the yarn end portion YP held in the clearance grooves 17*b* and 18*b*, but with the result that the yarn end portion YP remains uncut, still remaining connected between the suction mouth 11 and the package P, as shown in FIG. 21. After splicing, the swiveling guides 17 and 18 are rotated back to their original positions, causing the yarn ejecting lever 201 to drive the yarn end portion YP from the relief grooves 17*b* and 18*b*. The yarn end portion YP thus ejected is then guided to pass, along with the yarns YB engaged in the hook portions 17*c* and 18*c*, into the detecting channel 200 of the detector 8.

As a result, the detector 8 can detect a defective splicing such as a double yarn, if any. When the cutter 106 continues to fail in function, each action to complete the splicing results in a defective splicing so that winding onto the package is prevented until a correct splicing is formed.

Figure 24:
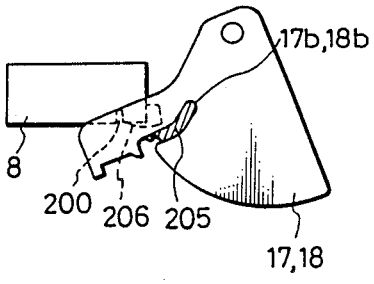
FIG. 24 is a plan view of a modified form of a device which guide a yarn into the detector.

In this particular embodiment, although the yarn ejecting lever 201 is employed to drive a yarn end portion YP from the relief grooves 17*b* and 18*b* into the detecting channel 200 of the detector 8, this is a matter of choice. Alternatively, a guide 206 may be employed to guide a yarn portion YP into the detecting channel 200 of the detector 8, with the relief grooves 17*b* and 18*b* being covered with a covering 205, as shown in FIG. 24.

It will easily be appreciated that the method aforementioned can detect a defective splicing such as a double yarn which occurs when a superfluous yarn end portion fails to be cut off from a main yarn leading to a package after splicing, preventing winding of a yarn with a defective splicing onto the package.

What is claimed is:

1. A method for preventing defective splicing in an automatic winder in which two ends of cut yarns are spliced after being guided into a yarn splicing device and then a winding operation is re-started, the method comprising the steps of:

clamping a superfluous yarn portion branching off from the joint of the spliced yarn; and starting a drum to cause a package to start winding after the superfluous yarn portion is clamped.

2. The method as claimed in claim 1, wherein the step of clamping a superfluous yarn portion comprises the step of clamping a desirable portion of yarn between a suction mouth arranged to introduce a yarn leading to a package into the splicing device, and the yarn splicing device.

3. The method as claimed in claim 1, wherein the step of clamping a superfluous yarn portion comprises the step of clamping the yarn portion at the top end of a relay pipe provided for introducing a yarn leading from a bobbin-side into the yarn splicing device.

4. A method for splicing of cut yarns for an automatic winder, comprising the steps of clamping one end of a cut yarn leading from a bobbin with a clamping device, grasping the cut yarn with a suction port of a relay pipe by suction, splicing the yarn while the yarn is clamped, and momentarily opening the clamping device following each splicing operation to discharge yarn breakages removed during the splicing.

5. A method for detecting defective splicing in an automatic winder comprising steps of intersecting a yarn from a bobbin and a yarn to a package in a yarn splicing device; actuating a cutter arranged to cut off a yarn end portion extending from the yarn splicing device; splicing both yarns after the cutter is actuated; starting a yarn winding operation by drawing up a yarn from a bobbin and winding the yarn on a package; and introducing a spliced yarn into a detecting channel of a detector for detecting a yarn defect, along with a cut-failed yarn branching off from the spliced joint of the spliced yarn.

6. A device for preventing defective splicing in an automatic winder which includes a detector, a pair of swivelable guides mounted on opposite sides of the detector and a fixed guide mounted on one side of the detector along a yarn passage from the bobbin toward a package, said device comprising a clamping lever pivotably disposed for swiveling motion, wherein said fixed guide is provided with a clamping surface arranged to clamp the package side yarn with the clamping lever so that a superfluous yarn portion branching off from the joint of the spliced yarn is clamped between the clamping surface and the clamping lever.

7. An apparatus for preventing defective splicing in an automatic winder which includes a splicing device, a suction mouth and a relay pipe having an open end portion for introducing a yarn leading from a package side and introducing a yarn leading from a bobbin side into the splicing device, respectively, the apparatus comprising a clamping member disposed at the open end portion of the relay pipe, the clamping member comprising a block having a throughhole and an end face, a clamp plate pivoted for moving close to and away from the end face of the block, a cover pivotally disposed to move integral with the clamp plate and a spring for urging the cover closed.

8. A method as claimed in claim 5, wherein the step of introducing comprises the step of inserting the spliced yarn and the cut-failed yarn branching off from the spliced joint into the detecting channel of the detector with a yarn ejecting lever device having levers arranged adjacent the ends of the detector.

9. A method of preventing splicing defects in a winder having a yarn splicer for splicing a first length of yarn extending from a yarn package with a second length of yarn extending from a bobbin, the method comprising the steps of:

clamping the first length of yarn at a first location along the first length of yarn; and splicing the first and second lengths of yarn together at a second location along the first length of yarn, the second location being arranged between the first location and the yarn package.

10. A method as claimed in claim 9, further comprising the step of winding yarn from the bobbin to the yarn package following the step of splicing and during the step of clamping.

11. A method as claimed in claim 9, further comprising the step of actuating a first yarn cutter arranged to cut the first length of yarn at a third location along the first length of yarn, between the first and second locations.

12. A method as claimed in claim 10, further comprising the step of clamping the second length of yarn at a first location along the second length of yarn, wherein the step of splicing comprises splicing the first and second lengths of yarn together at a second location along the second length of yarn, the second location being arranged between the first location along the second length of yarn and the bobbin.

13. A method as claimed in claim 12, further comprising the step of winding yarn from the bobbin to the yarn package following the step of splicing and during the steps of clamping.

14. A method as claimed in claim 13, wherein the steps of clamping continues during the step of splicing.

15. A method as claimed in claim 12, further comprising the step of actuating a second cutter arranged to cut the second length of yarn at a third location along the second length of yarn, between the first and second locations along the second length of yarn.

16. In a winder, a yarn splicing device for splicing a first length of yarn extending from a yarn package with a second length of yarn extending from a bobbin, the device comprising:

first yarn clamping means operable for clamping the first length of yarn at a first location along the first length of yarn; and yarn splicing means operable for splicing the first and second lengths of yarn together at a second location along the first length of yarn, the second location being arranged between the first location along the first length of yarn and the yarn package.

17. A yarn splicing device as claimed in claim 16, further comprising winding means for winding yarn from the bobbin to the yarn package following a splicing operation and during a clamping operation.

18. A yarn splicing device as claimed in claim 16, further comprising a first yarn cutter arranged adjacent the first length of yarn between the first and second locations along the first length of yarn.

19. A yarn splicing device as claimed in claim 16, further comprising a second yarn clamping means operable for clamping the second length of yarn at a first location along the second length of yarn, wherein the yarn splicing means operates to splice the first and second lengths of yarn together at a second location along the second length of yarn, the second location being arranged between the first location along the second length of yarn and the bobbin.

20. A yarn splicing device as claimed in claim 19, further comprising a second yarn cutter arranged adjacent the second length of yarn between the first and second locations along the second length of yarn.

* * * * *